United States Patent [19]

Gesing et al.

[11] 4,443,313

[45] Apr. 17, 1984

[54] ELECTROLYTIC REDUCTION CELLS

[75] Inventors: Adam J. Gesing, Kingston, Canada; John McIntyre, Tucson, Ariz.; Meine Vandermeulen, Kingston, Canada; Edward L. Cambridge, Tucson, Ariz.; Thomas P. DeAngelis, Horsehead, N.Y.

[73] Assignee: Alcan International Limited, Montreal, Canada

[21] Appl. No.: 391,404

[22] Filed: Jun. 23, 1982

[30] Foreign Application Priority Data

Jun. 25, 1981 [GB] United Kingdom ..... 8119587

[51] Int. Cl.[3] ..... C25C 3/08; C25C 7/02; C25C 7/06

[52] U.S. Cl. ..... 204/240; 204/243 R; 204/245; 204/284

[58] Field of Search ..... 204/243 R–247, 204/67, 294, 284

[56] References Cited

U.S. PATENT DOCUMENTS

| | | | |
|---|---|---|---|
| 4,071,420 | 1/1978 | Foster, Jr. et al. | 204/243 R |
| 4,093,524 | 6/1978 | Payne | 204/243 R X |
| 4,231,853 | 11/1980 | Rahn | 204/243 R |
| 4,333,813 | 6/1982 | Kaplan et al. | 204/243 R |
| 4,338,177 | 6/1982 | Withers et al. | 204/243 R |
| 4,349,427 | 9/1982 | Goodnow et al. | 204/294 X |
| 4,410,403 | 10/1983 | Jacobs et al. | 204/243 R X |

*Primary Examiner*—Donald R. Valentine

*Attorney, Agent, or Firm*—Cooper, Dunham, Clark, Griffin & Moran

[57] ABSTRACT

In an electrolytic reduction cell for the production of molten metal, particularly aluminium, by electrolysis of a less dense salt monolayer of ceramic shapes is located on the floor of the cell. Such shapes are formed of a ceramic material, wettable by molten aluminium, but not wettable by the cell electrolyte. The spacing between adjacent shapes and/or the apertures in individual shapes is selected such that interfaced surface forces prevent entry of electrolyte between the shapes. The shapes may be tiles, honeycombs, cylinders, tubes, balls etc. The product metal may be collected in a sump for periodic withdrawal from the cell or withdrawn continuously or at short intervals through a selective filter that permits passage of molten metal, but not of molten cell electrolyte, at low withdrawal rates.

5 Claims, 8 Drawing Figures

ELECTROLYTIC REDUCTION CELLS

The present invention relates to electrolytic reduction cells and in particular electrolytic reduction cells in which a metal is produced by electrolysis of a fused salt electrolyte, which is less dense than the product metal and is arranged between one or more overhead anodes and a cathodic cell floor. In such cells the product metal collects on the cell floor and constitutes the cathode of the cell.

In one well-known example of processes carried out in an electrolytic reduction cell, aluminium is produced by electrolysis of alumina in a fused fluoride electrolyte and the present invention is hereinafter described in relation to electrolytic reduction cells for the production of aluminium, while being applicable to electrolytic reduction cells in which similar electrolytic reduction processes are carried out.

In a conventional electrolytic reduction cell for the production of aluminium the molten electrolyte is contained beneath a frozen crust of fluoride electrolyte and alumina feed material and floats upon a molten metal layer which constitutes the cathode of the cell and is electrically connected with the electrical supply of the cell through a conductive floor structure, usually constituted by graphite blocks.

In such a cell it is standard practice to operate the cell with the bottom face of the anode(s) at a distance of 4–5 cms. from the datum position of the electrolyte/molten metal interface.

It has long been appreciated that substantial savings in the electrical energy required for the operation of the cell could be achieved by reducing the anode/cathode distance of the cell and many proposals have been put forward to achieve that result.

One of the reasons why it has been found impracticable to reduce the anode/cathode distance in conventional electrolytic reduction cells is that the molten metal is subject to strong magnetic forces in the horizontal plane as a result of the interaction of horizontal current components in the molten metal with the strong magnetic fields existing within the cell. The magnetic forces acting on the molten metal lead to wave action in such metal, with consequent intermittent shorting between the anodes and the molten metal cathode, if the anode/cathode distance is reduced below the conventional 4–5 cms. distance.

The cell electrolyte is replenished at intervals with alumina. For that purpose the frozen crust is broken at intervals and in the course of such crustbreaking, relatively large lumps of frozen crust, containing a high proportion of alumina, frequently fall into the bath. Because such lumps are of a density close to or even exceeding the density of the product metal they may penetrate the molten metal cathode layer. As the lumps of crust melt they form a sludge layer in the bottom of the cell beneath the molten metal. The sludge is believed to form discontinuous deposits on the cell floor, since the presence of sludge in a conventional cell leads to only small increase in the cell voltage, although the electrical resistance of the sludge is quite high in relation to the electrical resistance of molten aluminium. It is therefore believed that the passage of the cathode current to the cathodic floor is through molten metal in direct contact with such floor.

In the practical operation of a standard electrolytic reduction cell for the production of aluminium it is found that the sludge content of the cell remains substantially constant and it is believed that the electrolyte content of the sludge slowly takes up the solid alumina and migrates back to the electrolyte via the surface of the frozen electrolyte, which is present at the cell walls in conventional reduction cells, since the liquid components of the sludge can wet the surface of the frozen electrolyte. As already indicated the presence of sludge in conventional electrolytic reduction cell does not lead to severe operational problems.

It has already been proposed in British Patent Specification No. 2,069,530 to restrict movement of the molten metal layer by introducing a packed bed of loose packing elements into the molten metal. The proposed packing elements were necessarily of a material which is resistant to molten metal and it was suggested that the refractory material should be made from a boride of titanium and/or other elements, particularly tantalum, niobium, aluminium and zirconium. Such borides are more dense than molten aluminium, and are resistant to attack by molten aluminium although they are wetted by it. They are also resistant to attack by the molten fluoride electrolyte, but are not wetted by such electrolyte. All such borides exhibit electrical conductivity.

It has now been realised that in a large commercial-scale electrolytic reduction cell, e.g. of a capacity of 80 kA and upwards, the use of random packed beds of packing elements may have a number of disadvantages. In particular it has been realised that random packed beds may be in general subject to penetration by sludge and build-up of sludge therein. With build-up of sludge in the packed bed and displacement of metal therefrom, the packed bed may become a more or less uniform layer of relatively high resistance (in relation to molten metal) extending over the whole floor area of the cell beneath the anode(s) (the anode shadow.).

The consequent increase in resistance would thus defeat the purpose of stabilising the liquid metal cathode to permit reduction of the anode/cathode distance and reduction of the resistance exercised by the molten electrolyte.

Local differences in thickness of the packed bed may lead to the presence of a thin layer of metal in random areas above the bed where bed thickness is locally reduced. This would lead to destabilisation in the distribution of horizontal currents in the molten metal, with essentially unforeseeable results on the magnetic forces acting in both horizontal and vertical directions on the molten metal, and on the effects of such forces on the molten metal.

It has now been realised that many of these foreseeable difficulties may be obviated by making use of the interfacial tension forces at the molten metal/electrolyte interface. Such forces may be employed to restrain the entry of the molten electrolyte and sludge particles into the bed if the interstices between the metal-wettable packing elements are held below calculable dimensions. The critical dimensions are dependent upon the height of the packing elements above the metal level in the collection sump and on the size of the interstices which will permit entry of metal (which wets the packing elements) by capillary action, but restrain the entry of the bath electrolyte and sludge. These dimensions are calculable from available data concerning the interfacial forces at the electrolyte/metal interface at the cell operating temperature. When the interstices in the packed bed are sized such that the electrolyte cannot enter it, the metal is retained in the bed, in the same way as the water is retained in a wet sponge. Such packed bed then behaves as if it was a solid, metal-wettable body in which metal humping and metal wave formation are substantially inhibited by the interfacial forces. It has also been realised that the depth of the packing bed may be maintained essentially constant if the bed consists of a monolayer of objects, which are arranged so as to maintain a substantially constant spatial position in relation to the cell floor.

Thus an electrolytic reduction cell of the type under consideration may be characterised by a packing layer on the floor of the cell, composed of a monolayer of packing elements restrained against substantial movement in relation to adjacent packing elements, the individual packing elements having a substantially equal height in relation to the cell floor, the individual elements having a surface which is resistant to attack by and wettable by the molten metal, but not wettable by the molten electrolyte and of a greater density than the molten product metal, the spacing between individual elements or apertures in such elements being of such size that the molten electrolyte and sludge particles are restrained against entry into such bed by the interfacial tension forces.

From available information as to the surface forces at an interface between aluminium metal and fused fluoride electrolyte at 970° C. it can be estimated from the following formula $$h=2\gamma/\Delta\rho.g.r.$$

where h is the height of the molten aluminium column $\gamma$ is the interfacial tension at the metal/electrolyte interface $\Delta\rho$ is the density difference between molten Al and molten electrolyte g is acceleration due to gravity r is the effective radius of the aperture that molten aluminium will rise in a 6 mm diameter circular aperture in a block of titanium boride under a layer of the cell electrolyte to a height of approximately 30 cm by capillary action. Such metal prevents entry of electrolyte into the said aperture. Thus a closely packed bed of metal-wettable elements may be arranged to withstand any substantial penetration of the bed by fused electrolyte-coated sludge particles, irrespective of the size of such sludge particles.

In the electrolytic reduction cell of the present invention the packing layer may be composed of loose elements such as balls or cylinders of appropriate diameter or may be formed of elements made from honeycomb-section material, having appropriately sized apertures therein to prevent entry of sludge particles when the apertures are filled with molten aluminium. Honeycomb-section material is a preferred form of packing, because it minimizes the amount of ceramic material which has to be used for a layer of a given depth.

Where a tightly packed monolayer of loose elements is provided in the bottom of the reduction cell they are effectively restrained against movement in relation to each other in the horizontal plane by contact with adjacent elements. In the vertical direction they are restrained by gravitational force.

The external geometric shape of the honeycombs can be selected as desired from any regular or irregular geometric shape, e.g. square, round, although a preferable shape is rectangular, hexagonal or other polygonal configuration that allows close packing in the cell.

Honeycomb material for use in the present invention is preferably of a ceramic nature, initially produced in a "green" form by extrusion or other suitable fabrication technique. The honeycomb material may be produced with interlocking formations to enable adjacent packing elements to be maintained in essentially fixed relationship in relation to one another. As an alternative a honeycomb-like or similar structure may be built up from a plurality of ceramic elements formed by extrusion or other suitable fabrication technique, interconnected by means of spaced fixer elements.

The essential feature of the packing layer is that it shall be formed of a monolayer of metal-wettable packing elements, which present upwardly facing openings, between or in the elements, of such restricted size that molten metal may flow down through or between the elements but the molten electrolyte, which does not wet the packing elements, is restrained from entry by the surface tension forces at the molten metal/electrolyte interface.

The actual maximum permissible spacing between individual elements in the monolayer and/or the size of apertures in individual elements, such as honeycombs or tubes is dependent upon, amongst other factors, the surface tension, density difference between metal and electrolyte and the height of the packing elements above the metal level in the sump.

It will be appreciated that an opening in or between adjacent packing elements may be in the form of a slit of essentially indefinite length. The restraint exerted by surface forces against entry by electrolyte-coated sludge particles is dependent upon the width of such slit.

A general formula for the maximum permissible width, w, of such slit, in relation to the maximum electrolyte layer thickness is:

$$w=2\gamma/\Delta\rho.g.h.$$

It will be appreciated that the same relationship holds where the monolayer is composed of solid triangular, square or rectangular or hexagonal tiles which can be maintained as a monolayer at fixed spacings from one another. Where such packing elements are employed they are preferably formed with integral spacer projections which are of such dimensions as to hold the tiles slightly spaced apart from one another, but at a distance insufficiently large as to permit entry of sludge, i.e. a distance not exceeding the maximum permissible value of w, given by the above formula. It should be noted that the maximum width of a slit is half the maximum permissible diameter of a circular orifice.

In U.S. Pat. No. 4,231,853 there has already been discussed a system in which an array of tiles formed of titanium diboride or like material is secured to the carbon floor of an aluminium reduction cell by means of one or more electrically conductive pins for each tile. The pins are stated to conduct current to the carbon floor irrespective of the presence of sludge at the bottom of the cell and the purpose of the arrangement is to allow the conductive tiles to expand and contract freely in relation to the carbon floor to avoid setting up stresses due to differential expansion. It is stated that the tiles may be perforated to economise on the material employed, but it appears to have been foreseen that the sludge will enter the spaces between the individual tiles to contact the floor and no suggestion is made that the perforations in the tiles are sufficiently small in size to prevent the entry of sludge.

As already stated the packing elements employed in the electrolytic reduction cell of the present invention must be both metal-wettable and resistant to molten metal. They may be electrically conductive, as for example wholly formed from a selected metal boride, or essentially electrically non-conductive, for example alumina balls provided with a surface coating of a metal boride. The packing elements preferably take the latter form for solely economic reasons, because of the high cost of the appropriate metal borides.

In the operation of the cell the level of the molten metal is maintained as close as possible to the tops of the packing elements so as to avoid, as far as possible, the existence of a thin surface layer of metal above the packing layer, in which there would be lateral current components of very high current density, particularly where the packing elements are non-conductive. For this reason the cell is preferably arranged so that the product metal can drain away from the packed bed to maintain the molten metal at a substantially constant level, as opposed to the normal practice of allowing the molten metal to accumulate at the cell bottom for periodic removal of a batch of molten metal.

For this purpose the cell may conveniently be provided with a selective filter device which permits the passage of molten metal and restrains the passage of molten electrolyte as described in co-pending British patent application No. 8,119,589.

This device is effective to remove molten metal continuously at the rate of production so as to maintain the molten metal at a substantially constant level in the bottom of the cell.

Alternatively molten metal may be collected in a sump in the cell floor at a location outside the anode shadow, in which case molten metal is retained in the packing layer exclusively by surface tension forces.

The overall depth of the monolayer of packing elements in accordance with the present invention, is preferably in the range of 1–5 cm, but may in some circumstances be less or more. The depth of the packing layer is determined by the height or thickness of the packing elements. The aspect ratio of height to lateral dimension of the element should be such that they are not prone to topple over, or climb up on top of each other as the result of horizontal forces exerted by the molten metal which surrounds them.

As compared with the use of a packed bed of randomly arranged, unsized packing elements, the use of a monolayer of correctly sized packing elements has the positive advantage of restraining metal wave motion without incurring sludge problems. It is also far more economical in its use of expensive material, particularly where the elements are composed solely of a metal boride, such as titanium boride. As compared with a conventional electrolytic cell the layer of molten metal lying within the packing layer is very shallow and thus the amount of molten metal necessarily retained within the cell is greatly reduced and this in itself is a substantial economic advantage.

Referring now to the accompanying drawings

FIG. 1 diagrammatically illustrates the use of a packing layer in accordance with the invention in an essentially conventional electrolytic reduction cell.

Figure 1:
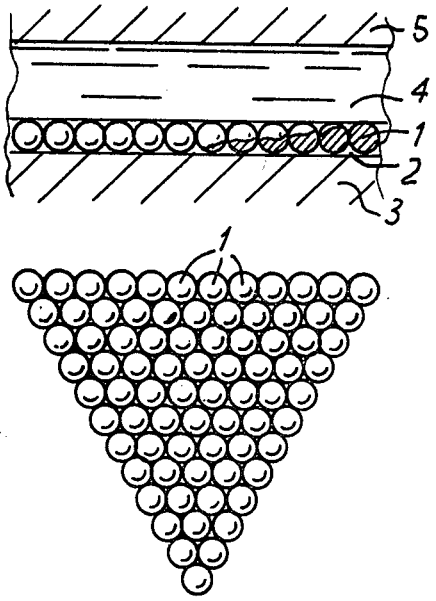

In FIG. 1 the packing layer is formed of equal sized balls 1 of a diameter in the range 5–50 mm. These may be of solid titanium diboride or other metal-wettable boride or of ceramic material, such as fused alumina, coated with a metal-wettable boride. The balls 1 are as closely packed as possible in a monolayer and lie in a layer 2 of molten aluminium (or other product metal) of a depth substantially equal to the diameter of the balls 1. The balls 1 and layer 2 are supported on a conventional flat cathodic floor composed of carbon blocks 3. An electrolyte 4 lies between the metal layer 2 and the undersurface of a suspended anode 5.

In a full-size commercial electrolytic reduction cell of typical capacity in the range of 80–150 kA and current density of 0.8 $A/cm^2$ at the molten metal cathode surface, the distance between the molten metal cathode layer 2 and the anode 5 may be maintained at a distance of 2–3 cm which represents an electrical energy saving of the order of 10–20% as compared with the conventional anode/cathode spacing of about 5 cm.

Figure 2:
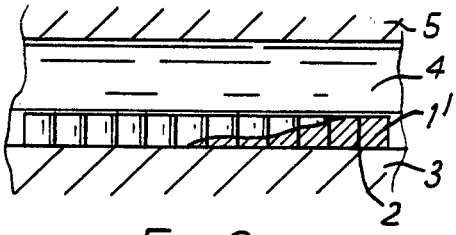
FIG. 2 illustrates the use of a packing layer composed of loose solid cylindrical rods.

In FIG. 2 the packing elements are composed of solid cylindrical titanium diboride rods 1', having a height substantially equal to their diameter.

Figure 3:
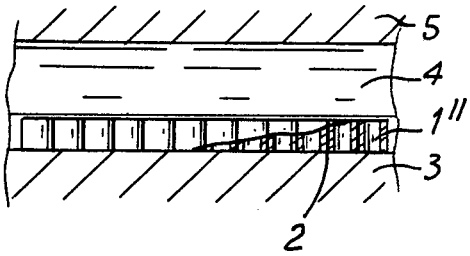
FIG. 3 illustrates the use of s packing layer composed of loose tubular elements.

In FIG. 3 the packing elements are in the form of cylindrical tubes 1'' having an internal diameter sized to avoid entry of electrolyte therein by reason of interfacial tension forces.

In FIGS. 2 and 3 other reference numerals indicate the same elements as in FIG. 1.

Figure 4:
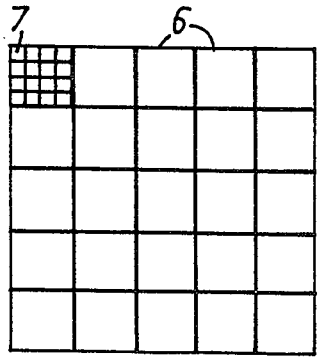
FIG. 4 is a plan view of a packing layer composed of rectangular honeycomb elements.

In FIG. 4 the packing is composed of closely abutted, shallow, rectangular titanium diboride ceramic honeycomb elements 6, having rectangular cells 7 of appropriate size to prevent electrolyte entry.

Figure 5:
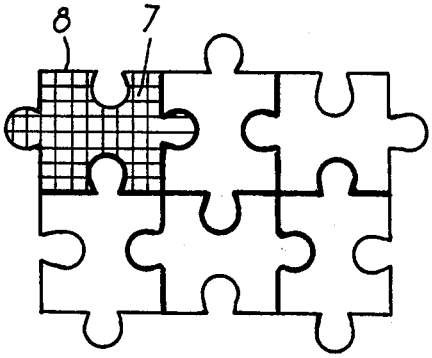
FIG. 5 is a plan view of a packing layer composed of interlocking honeycomb elements.

In FIG. 5 the packing elements 8 are likewise titanium diboride ceramic honeycomb, shaped to interlock with each other to restrain them against mutual displacement to prevent the development between adjacent packing elements of spaces through which electrolyte and sludge can penetrate into the molten metal layer.

Figure 6:
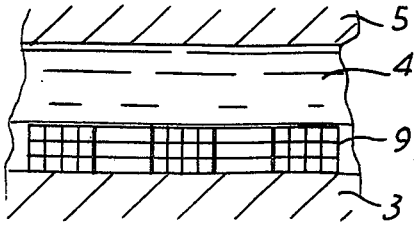
FIG. 6 is a sectional view of a packing layer of honeycomb elements with horizontally disposed channels.

In FIG. 6 the packing elements 9 are square elements, as in FIG. 4, but in this case the cells 7 extend in the horizontal plane. The cellular passages in adjacent elements are preferably arranged perpendicular to one another to restrict metal motion in the longitudinal direction of the cellular passages.

Figure 7:
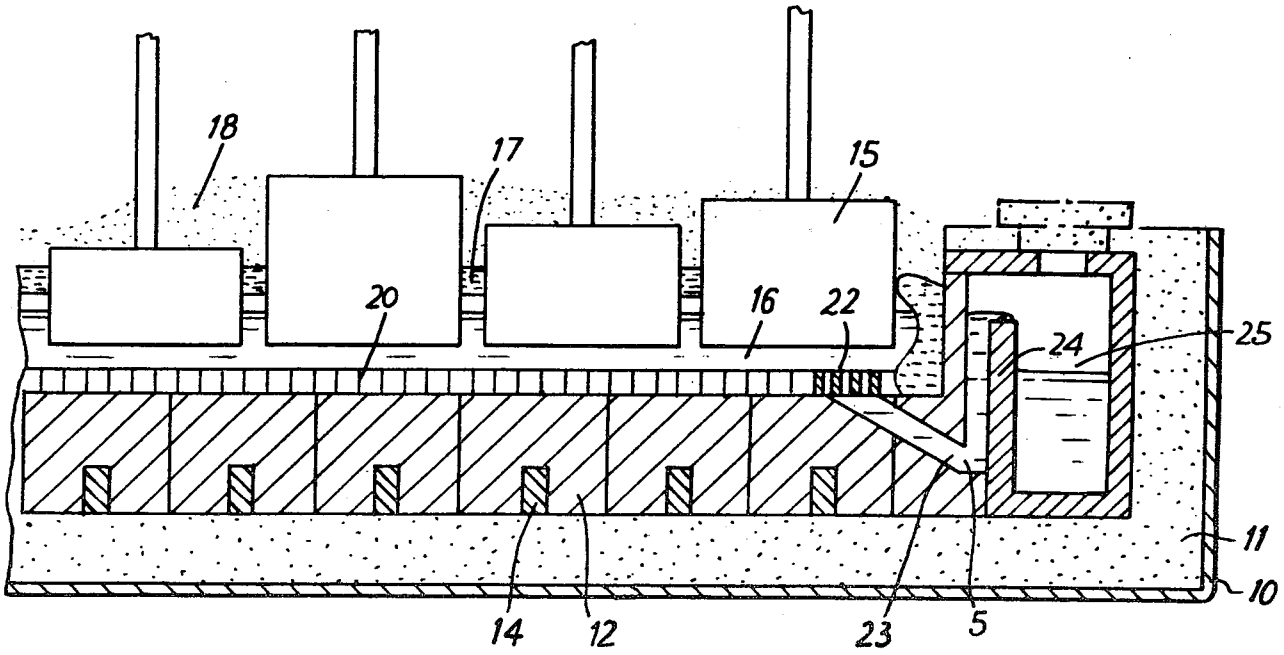
FIG. 7 is a partial diagrammatic longitudinal section of one form of cell equipped with a packing layer in accordance with the invention.

In FIG. 7 the cell includes a metal shell 10, containing a layer of thermal insulation 11 and including conventional carbon cathode floor blocks 12 in electrical contact with conventional steel cathode current collector bars 14. The cell includes one or more rows of conventional prebake carbon anodes 15, suspended in contact with the molten cell electrolyte 16, which is contained beneath in a frozen crust 17 of solid electrolyte, supporting feed alumina 18 in a conventional manner.

On the bottom of the cell is supported a layer 20 of packing elements, composed of any of the forms of packing elements illustrated in FIGS. 1–6 and contained within a layer of molten aluminium of substantially the same depth as the packing element layer 20.

Accumulating product metal is continuously drained out of the cell by means of selective filter 22 of any of the types described in the aforesaid co-pending patent application to maintain the depth of the metal layer at a substantially constant value.

The molten metal in FIG. 7 flows downwardly through the filter 22 into the passage 23 and over a weir 24 into a collecting vessel 25, from which molten metal is withdrawn at intervals. The electrolyte 16 is maintained at such a level in relation to the weir 24 that it exerts a slight hydrostatic head to drive the molten metal selectively through the filter, while the electrolyte itself is retained on the upstream side of the filter by surface tension forces.

With this arrangement the anode/cathode distance between the lower faces of the anodes 15 and the top surface of the metal layer may be reduced in relation to the conventional anode/cathode distance. This leads to a substantial reduction in the electrical energy required per tonne of metal product.

Figure 8:
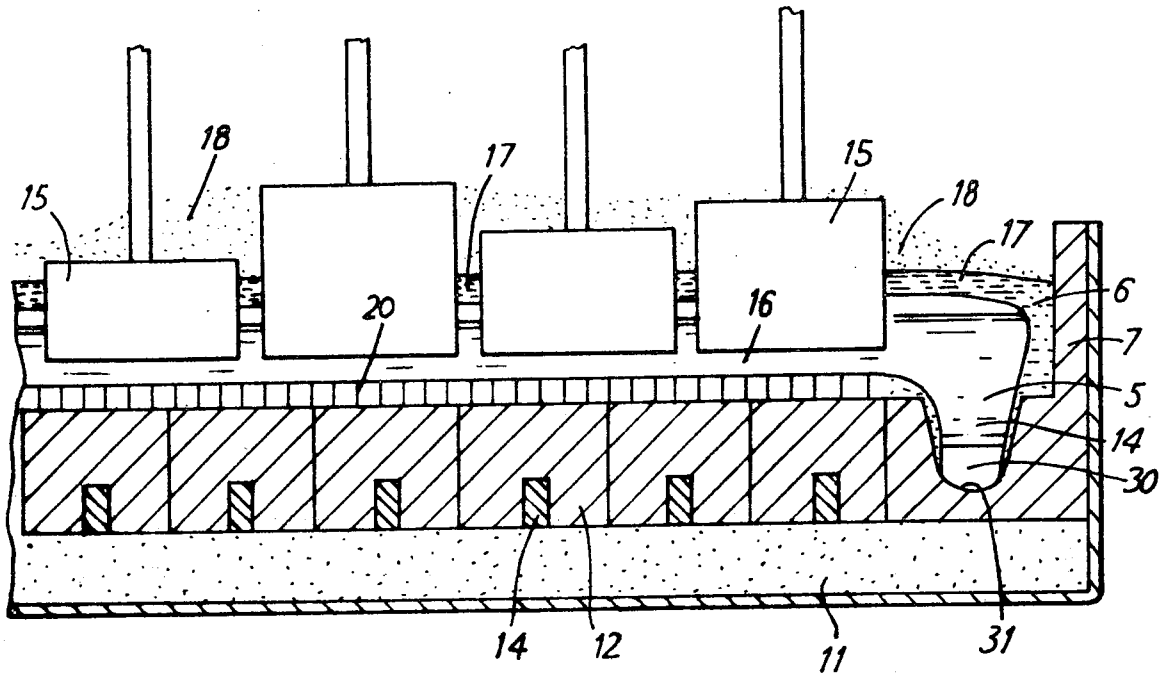
FIG. 8 is a partial diagrammatic longitudinal section of another form of cell in accordance with the invention in which molten metal is collected in a sump, for periodic removal.

In FIG. 8 like parts are identified by the same referance numerals as in FIG. 7. In FIG. 8 a pool of molten metal 30 is collected in a sump 31 at one end of the cell, outwardly of the shadow of the anodes 15. As will be understood from the foregoing discussion the packing elements in layer 20 are sized to provide interstices of a size less than the permissible maximum.

The installation of the packing elements to form a level monolayer of packing elements (other than the interlocking elements of FIG. 5) in the cell can be achieved in a very simple manner by first installing a monolayer of packing elements in an open-topped shallow mould of 50 cms×50 cms, for example, and then pouring the molten product metal into the mould to a depth sufficient to submerge the packing elements. In this way the packing elements are incorporated into panels of the solid product metal for easy installation into the reduction cells. Such product metal is rapidly melted when the cell is brought into operation.

It is well known that anodes may drop into the bottom of an electrolytic reduction cell by accident during anode change or during normal cell operation.

The ceramic elements in the bottom of the cell are both hard and brittle and are high-cost components. It is therefore desirable to protect them from being damaged by dropped anodes. To this end three or more spaced blocks are provided under each anode and extend very slightly (up to 1 cm) above the top of the layer of ceramic elements. The blocks are essentially massive and may for example be 10×10 cms. in section. The blocks must be resistant to attack by both molten metal and molten electrolyte and are preferably formed of non-conductive material to avoid the possibility of heavy local current concentrations in the event of the blocks protruding above the level of the molten metal into the molten electrolyte.

We claim:

1. An electrolytic reduction cell for the production of a molten metal by electrolysis of a fused electrolyte, which is less dense than the molten product metal, said cell having one or more overhead anodes and a cathodic floor and having a layer of ceramic shapes arranged on said cathodic floor, said shapes being formed of a material which is resistant to attack by said molten metal and said fused electrolyte, is more dense than said product metal and is wettable by said product metal, but is non-wettable by said electrolyte characterised in that said shapes constitute a monolayer of tiles in the form of honeycomb having apertures formed therein, of such dimensions as to restrain electrolyte-coated sludge particles from entry into such apertures.

2. An electrolytic reduction cell according to claim 1 further characterised in that said tiles are in the form of honeycomb, having vertically directed apertures therein.

3. An electrolytic reduction cell according to claim 1 further characterised in that said tiles are in the form of honeycomb, having horizontally directed apertures therein.

4. An electrolytic reduction cell according to claim 1 further characterised in that a sump is provided in said cell at a location outside the shadow of the anode(s) for collection of molten metal, the apertures in said monolayer of ceramic shapes being sized in relation to the thickness of said monolayer in such a manner that said apertures are maintained substantially full of molten metal by surface forces acting at the metal/electrolyte interface.

5. An electrolytic reduction cell according to claim 1, further characterised in that a selective filter is arranged in said cell to permit outflow of molten metal but to restrain flow of molten electrolyte, said filter being arranged to permit passage of molten metal at a rate in excess of its production and being arranged to co-operate with metal level control means located externally of said cell.

* * * * *